United States Patent [19]

Aoki et al.

[11] 4,367,275

[45] Jan. 4, 1983

[54] METHOD OF PREVENTING OFFSET OF ELECTROSTATIC IMAGES AFTER FIXING AND DEVELOPING USING POLYVALENT METAL SALT POLYMER IN TONER

[75] Inventors: Takayoshi Aoki, Urawa; Akio Kinoshita, Fujimi, both of Japan

[73] Assignee: Dainippon Ink & Chemicals, Inc., Tokyo, Japan

[21] Appl. No.: 300,642

[22] Filed: Sep. 9, 1981

Related U.S. Application Data

[63] Continuation of Ser. No. 158,375, Jun. 11, 1980, abandoned.

[30] Foreign Application Priority Data

Jun. 15, 1979 [JP] Japan ..... 54/74644

[51] Int. Cl.[3] ..... G03G 9/08

[52] U.S. Cl. ..... 430/99; 430/110; 430/109

[58] Field of Search ..... 430/99, 110, 109

[56] References Cited

U.S. PATENT DOCUMENTS

| | | | |
|---|---|---|---|
| 2,890,968 | 6/1959 | Giaimo | 430/110 |
| 3,262,806 | 7/1966 | Gourge | 430/108 |
| 3,590,000 | 6/1971 | Palermita et al. | 430/904 |
| 3,788,995 | 1/1974 | Stahly et al. | 526/240 |
| 3,795,618 | 3/1974 | Kasper | 430/108 |
| 3,898,171 | 8/1975 | Westdale | 430/110 |
| 4,040,970 | 8/1977 | Tsuneda | 526/240 |
| 4,267,246 | 5/1981 | Nishibayashi | 430/99 |

*Primary Examiner*—John D. Welsh

*Attorney, Agent, or Firm*—Sherman & Shalloway

[57] ABSTRACT

A toner for development of latent electrostatic images comprising a coloring agent, a binder resin and a fixing aid, said binder resin comprising a polyvalent metal salt (b) of a carboxyl-containing addition polymer (a) which satisfies the following expressions:

$$10^{-2} < (N \cdot \overline{M}w)/2 < 10$$

$$10^{-5} < N < 2 \times 10^{-3}$$

wherein N is the number of moles of metal carboxylate ions contained per gram of the polyvalent metal salt (b), and $\overline{M}w$ represents the weight average molecular weight of the addition polymer (a), and said fixing aid comprising at least one compound selected from the group consisting of waxes, fatty acid amides and metal soaps.

10 Claims, No Drawings

METHOD OF PREVENTING OFFSET OF ELECTROSTATIC IMAGES AFTER FIXING AND DEVELOPING USING POLYVALENT METAL SALT POLYMER IN TONER

This is a continuation of application Ser. No. 158,375, filed June 11, 1980, now abandoned.

This invention relates to a powdery toner for development of a latent electrostatic image in electrophotography or an electrostatic recording process. More specifically, this invention relates to a powdery toner for development of a latent electrostatic image, which has viscoelasticity in the heat molten state and is suitable for use in a hot roll fixing method.

Various methods of electrophotography have been disclosed in U.S. Pat. No. 2,297,691 and other patent documents, the literature and journals. An electrophotographic process generally comprises forming a latent electrostatic image by various means on a photosensitive member composed of a photoconductive material such as selenium, zinc oxide, vinyl carbazole compounds and cadmium sulfide, applying a toner to the latent image by a cascade method, a magnetic brush method, etc. to develop it, transferring the toner image to paper or other sheets, and then fixing the image under heat or pressure, with a solvent, etc.

The heat melting fixing method frequently used in commercial copying machines is roughly divided into a non-contact heating method and a contact heating method. The contact heating method is usually carried out by using a hot press roll. This fixing method has an excellent heat efficiency and permits high-speed fixing because the toner electrostatically moved to a transfer sheet is fixed by passing it through heated rolls whose surface has some mold releasability.

In recent years, the increasing of the durability of photosensitive materials, developers, etc. used in commercial copying machines and the improvement of electrical and mechanical devices used therein have led to the production of electrophotographic copying machines operable at high speeds or ultrahigh speeds. It is not too much to say that this is partly due to the employment of the hot press roll method in a fixing mechanism.

Some shortcomings of this fixing method have been pointed out. The most serious one is that the toner transferred to a transfer sheet moves to the fixing roller (i.e., the offset phenomenon). Generally, this phenomenon is prevented by using a material having a relatively good mold releasability as a surface of the roller, and further coating the roller surface with a liquid such as a silicone oil. By this method, the offset phenomenon can be prevented to a practically acceptable extent. The silicone oil, however, is consumed gradually as the copying process proceeds. If no device is provided for supplying the oil to the roll, such an offset phenomenon occurs as soon as all the oil coated on the roll surface or impregnated in the roll has been consumed. This defect can be removed in a fixing mechanism having means for supplying the oil. However, since a device for controlling the supply of the oil corresponding tothe amount of the oil consumed is required, the copying machine increases in cost and becomes complex in structure. Moreover, since the silicone oil is by no means inexpensive, such a fixing method is economically disadvantageous.

Prevention of the offset phenomenon by improving the fixing mechanism itself is disadvantageous as mentioned above, and investigations have been made for further improvement. Investigations have also been made about the improvement of toners, and various measures have been developed. For example, there have been suggested a method which involves increasing the width $\Delta T$ of a right fixing temperature (i.e., the temperatures between the minimum temperature at which the toner is fixed and the maximum temperature at which the toner is on the verge of moving to the roll) by controlling the melt viscosity of the toner (a first method), and a method which comprises adding a mold releasing agent to the toner to impart mold releasability to the toner itself (a second method).

The first method may be performed, for example, by (a) adding a heat-infusible inorganic fine powder, or (b) adding a high-molecular weight compound which is heat-infusible or highly viscous to a temperature of at least 150° to 200° C. Such a method aims at increasing the right fixing temperature width $\Delta T$ by reducing variations in melt viscosity against changes in heating temperature. But no complete solution can be obtained by such a method. For example, according to the method (a), the amount of the fine powder is difficult to increase to more than 30% by weight in view of the dispersibility, specific gravity and hygroscopicity of the additive, deterioration in the electrical properties of the toner owing to the additive, etc. If the amount is below 30% by weight, no good result can be obtained. The method (b) is relatively effective, but when a high-melting thermoplastic resin having little or no crosslinkages is used, its effect is insufficient. On the other hand, a high-melting thermoplastic resin having a relatively large amount of crosslinkages is difficult to produce, heat-melt and to finely pulverize.

The second method involving adding a mold releasing agent to the toner is advantageous because the melt viscosity of the toner need not to be so much considered. Usually, mold releasing agents used for this purpose must be used in a relatively large amount because there is a limit to their mold releasability. Moreover, many of such releasing agents are of low molecular weight. Thus, such a mold releasing agent adversely affects the durability of the toner and the cleanability of the photosensitive member. No doubt, the cleanability of the photosensitive member is a very important property in medium-speed, high-speed and ultrahigh-speed copying machines using a hot roll pressure fixing method.

It is a primary object of this invention therefore to provide a toner for development of latent electrostatic images, which has overcome all of the problems described above of the prior art.

Another object of this invention is to provide a toner for development of latent electrostatic images, which permits prevention of poor fixing or offset phenomenon without using an expensive mold releasing oil such as silicone oil by increasing the right fixing temperature width $\Delta T$ by controlling the melt viscosity of a toner binder resin.

Still another object of this invention is to provide a toner for development of latent electrostatic images, which permits prevention of poor fixing or offset phenomenon even when fixation is done by a hot press roll whose surface has degraded through long-term use, thereby prolonging the service life of the hot press roll.

Yet another object of this invention is to provide a toner for development of latent electrostatic images, which can be easily produced using a binder resin that can also be produced easily.

A further object of this invention is to provide a toner for development of latent electrostatic images, which does not contaminate the photosensitive material and permits good cleaning of the photosensitive member.

On extensive investigations, the present inventors have succeeded in achieving the aforesaid object by using a specified polyvalent metal salt of a carboxyl-containing polymer as a binder resin and a specified lubricant as a fixing aid.

Thus, the present invention provides a toner for development of latent electrostatic images comprising a coloring agent, a binder resin and a fixing aid, said binder resin containing a polyvalent metal salt (b) of (a) a carboxyl-containing addition polymer [to be referred to simply as a metal salt (b)] which meets the following expressions $$10^{-2}<(N.\overline{M}w)/2<10 \ldots \quad (1)$$

and $$10^{-5}<N<2\times10^{-3} \cdots \quad (2)$$

wherein N is the number of moles of metal carboxylate ions per gram of the metal salt (b), and $\overline{M}w$ is the weight average molecular weight of the polymer (a),
and said fixing aid being an external lubricant (c) for the metal salt (b).

The metal salt (b) used essentially as a binder resin in this invention broadly embraces thermoplastic resins called ionomers, and has a weak crosslinked structure by an ionic or coordinated bond. At room temperature, such a type of resin is tough and has superior abrasion resistance owing to the presence of a crosslinked structure. Under heat, this crosslinked structure is destroyed and the resin becomes melted. Accordingly, this temperature-viscosity change is suitable for toners used in hot roll fixation. In addition, the metal salt (b) used in this invention is a special type which meets the expresions (1) and (2). By this specific characteristic, the good fixability, melt kneadability and pulverizability of the toner are secured, and the offset phenomenon of the toner is effectively prevented.

When in the expressions (1) and (2), $(N.\overline{M}w)/2>10$ and/or $N>2\times10^{-3}$, viscosity flowability of the metal salt (b) at high temperatures becomes excessively low. Hence, adverse effects are exerted on the fixability, melt kneadability and pulverizability of the toner. In particular, when $N>2\times10^{-3}$, an adverse effect is also exerted on the charging characteristics of the toner. If $(N.\overline{M}w)/2<10^{-2}$ and/or $N<10^{-5}$, the viscosity flowability of the metal salt (b) at high temperatures become excessively high, and the offset phenomenon of the toner appears.

Various polymers can be used as the carboxyl-containing addition polymer (a) which forms the basis of the metal salt (b). For example, there are used polymers obtained by copolymerization of carboxyl-containing vinyl monomers and other vinyl monomers, polymers obtained by ionic polymerization of vinyl monomers using carbon dioxide gas as a polymerization stopper, polymers obtained by partially oxidizing polymers having an unsaturated double bond in the main chain or side chains, and polymers obtained by hydrolyzing polymers having an ester linkage in the side chains.

The following carboxyl-containing vinyl monomers and other vinyl monomers can be cited as main components of the structural units of the carboxyl-containing addition polymer (a).

Carboxyl-containing vinyl monomers

Acrylic acid, methacrylic acid, α-ethylacrylic acid, crotonic acid, isocrotonic acid, β-methylcrotonic acid, maleic acid, fumaric acid, itaconic acid, vinylacetic acid, angelic acid, tiglic acid, 4-pentenoic acid, citraconic acid, mesaconic acid, glutaconic acid, and α- or β-dihydromuçonic acid.

Other vinyl monomers

Alkyl esters, haloalkyl esters, alkoxyalkyl esters, aralkyl esters, alkenyl esters, aminoalkyl esters, amides and nitriles derived from the aforesaid unsaturated carboxylic acids; aliphatic monolefins such as ethylene, propylene, butene and isobutylene; halogenated aliphatic olefins such as vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide and vinylidene chloride; conjugated aliphatic diolefins such as 1,3-butadiene, 1,3-pentadiene, 2-methyl-1,3-butadiene, 2,3-dimethyl-1,3-butadiene, 2,4-hexadiene, and 3-methyl-2,4-hexadiene; and styrene and nuclearly substituted products of styrene having alkyl, halogen, nitro, alkoxy or acyl as a substituent.

Polyvalent metals such as Al, Ba, Ca, Cd, Co, Cr, Cu, Fe, Hg, Mg, Mn, Ni, Pb, Sn, Sr and Zn can be cited as metals which combine as cations with the carboxyl anions of the addition polymer (a) to form salts.

To form a salt by combining such a metal with the carboxyl-containing addition polymer, the addition polymer (a) may be reacted with a halide, hydroxide, oxide, carbonate, carboxylate, alkoxide, or chelate of the metal. The reaction can be effected by heating the required ingredients in the presence of a solvent with stirring; or by melting and kneading them in the absence of a solvent. When the aforesaid polyvalent metal does not combine with the carboxyl anion of the addition polymer (a) but a cation such as $NH_4^+$ combines with it, the resulting salt is thermally unstable, and releases gas when heated, leading to the possibility that the reversibility of the ionic bond will be lost. When a cation such as $Na^+$ combines with it, the resulting salt is hydrophilic, and a toner resulting from the use of such a salt greatly depends upon humidity, and the speed of decay of an electric charge becomes extremely fast. The purpose of using the aforesaid polyvalent metal in this invention is to remove such a defect.

In designing a toner suitable for a given copying mechanism, it is important to control the softening point of or melting point of the metal salt (b) produced. The present inventors made various investigations about this point, and obtained the following empirical formula (3) which is very effective for controlling the softening point of the metal salt (b).

$$T\approx T_o+K(M, \overline{M}w)\,(10^{-3}\cdot N)^n \quad (3)$$

wherein

T is the softening point (°C.) of the metal salt (b) determined by the ring and ball method, $T_o$ is the softening point of the carboxyl-containing addition polymer determined by the ring and ball method, K(M, $\overline{M}w$) is a coefficient having to do with the weight average molecular weight of the carboxyl-containing addition polymer (a) and the type of the metal forming the salt, N is the concentration of carboxyl ions contained in the metal salt (b), and n is a coefficient having to do with the type of the metal forming the salt.

It was found that when a carboxyl-containing addition polymer (a) having a weight average molecular weight of 6500 is formed into a salt using aluminum, K(M, $\overline{M}w$) in formula (3) is about 200 and n is 1.7; and that when the salt is formed using potassium, K(M, $\overline{M}w$) is about 45 and n is about 1. It will be appreciated that by using these results, the softening point of the metal salt (b) can be anticipated by properly prescribing the N value. By controlling the softening point of the metal salt (b), the softening point of the toner finally obtained is usually adjusted to 70° to 150° C.

Most desirably, the binder resin is composed solely of the metal salt (b). But the metal salt (b) may comprise at least 30% by weight of the entire binder resin. When another binder resin is to be used together, it may be any of those thermoplastic resins which are used in ordinary toners for development of latent electrostatic images. Examples of such thermoplastic resins are polystyrene, a styrene/acrylate copolymer resin, polyacrylates, polyethylene, a styrene/butadiene copolymer, polyamides, polyvinyl chloride, vinyl chloride/vinyl acetate copolymer, and coumarone-indene resin.

The external lubricant (c) for the metal salt (b) which is used as a fixing aid in the present invention serves mainly to reduce surface free energy between the toner and the fixing roll. Specific examples are given below.

WAXES

Paraffin wax and microcrystalline wax; polyolefin waxes such as low-molecular-weight polyethylene or low-molecular-weight polypropylene; and ester-type waxes such as butyl stearate, ethylene glycol monostearate, glycerin monostearate, glycerin monooleate, carnauba wax, montan wax and beeswax.

FATTY ACID AMIDES

Lauric amide, myristic amide, palmitic amide, stearic amide, arachidic amide, behenic amide, olefic amide, eicosanoic amide, erucic amide, elaidic amide, linolic amide, linoleic amide, ricinoleic amide, and methylenebisamide.

METAL SOAPS

Calcium stearate, calcium laurate, calcium ricinolate, zinc stearate, zinc laurate, lead stearate, and tin stearate.

These external lubricants (c) may be used singly or in combination with each other. The amount of the external lubricant is preferably 0.01 to 10% by weight, more preferably 0.1 to 5% by weight.

The coloring agent used in this invention need not to be a special one. Examples include carbon black, nigrosine dyes, aniline dyes, chrome yellow, ultramarine blue, methylene blue chloride, rose bengal, magnetite, and ferrite.

The following Examples specifically illustrate the present invention. Parts and percentages are by weight unless otherwise specified.

EXAMPLE 1

A 10% methanol solution (17.3 parts) of calcium methoxide was added to a solution of 160 parts of a terpolymer of ethyl methacrylate (48%), butyl methacrylate (44%) and acrylic acid (8%) (weight average molecular weight 19,000). The mixed solution was heated at 80° to 110° C. for 5 hours to distill off the solvents. Then, the solvents were completely removed by distillation under reduced pressure to form a binder resin.

The concentration (N) of metal carboxylate ions contained in this resin was $2.1\times10^{-4}$ (mole/g). Hence, $(N\cdot\overline{M}w)/2\approx2.0$. Thus, this binder resin satisfies the expressions (1) and (2).

| | |
|---|---|
| Binder resin | 88 parts |
| Nigrosine dye | 3 parts |
| Carbon black | 8 parts |
| Low-molecular-weight polyethylene | 1 part |

The above ingredients were melted and kneaded by a roll mill, cooled, and then pulverized. Finally, the pulverized product was finely pulverized by a jet mill to afford a toner for development of latent electrostatic images having an average particle diameter of 12 microns.

COMPARATIVE EXAMPLE 1

A binder resin was produced in the same way as in Example 1 except that the amount of the calcium methoxide solution was changed to 94 parts. The concentration (N) of metal carboxylate ions contained in this was $1.1\times10^{-3}$ (mole/g). Accordingly, $(N\cdot\overline{M}W)/2\approx10.45$. Hence, this resin does not satisfy the expression (1).

A toner for development of latent electrostatic images was produced in the same way as in Example 1 except that the binder resin obtained as above was used.

COMPARATIVE EXAMPLE 2

A binder resin was produced in the same way as in Example 1 except that the amount of the calcium methoxide solution was changed to 0.5 part. The concentration (N) of metal carboxylate ions in this resin was $6.1\times10^{-6}$ (mole/g). Accordingly, $(N\cdot\overline{M}w)/2$ is $5.8\times10^{-2}$, and this resin does not satisfy the expression (2).

A toner for development of latent electrostatic images was produced by the same procedure as in Example 1 except that this binder resin was used.

EXAMPLES 2 to 4

Toners for development of latent electrostatic images were prepared in the same way as in Example 1 except that each of the external lubricants shown in the following table was used as a fixing aid.

EXAMPLE 5

A toner for development of latent electrostatic images was prepared in the same way as in Example 1 except that a calcium salt of a styrene/butyl acrylate/acrylic acid terpolymer was used as the binder resin.

EXAMPLES 6 to 11

In these Examples, the Fe, Mg, Zn and Al salts respectively of a styrene/butyl acrylate/acrylic terpolymer as shown in the following table were used as the binder resin.

The binder resin (91 parts), 8 parts of carbon black and 1 part of low-molecular-weight polyethylene were heat-melted and kneaded by a roll mill, cooled, and pulverized. Finally, the product was finely pulverized by a jet mill to give a toner having an average particle diameter of 12 microns.

TEST EXAMPLE

Two types of commercially available copying machines mentioned in the following table were modified, and a copying test was performed using the toners obtained in Examples 1 to 11 and Comparative Examples 1 and 2 in the modified copying machines. In modifying the copying machines, the fixing mechanism was removed from the copying machines, and the electrical circuit was regulated so that the copying function would operate normally. This modification enabled the toner to be discharged onto the transfer sheet unfixed.

On the other hand, the unfixed image was fixed by using a fixing device consisting of a metal roll coated with polytetrafluoroethylene at the surface and having a roll surface temperature freely adjustable within the range of 140° to 200° C. by incorporating a heater therein, and a silicone rubber roll provided beneath the rubber roll in contact there with.

The results of the test are shown in the following table.

It is seen from the results that the toners obtained in Examples 1 to 11 can permit securing of the right fixing temperature width ΔT of at least 30° C. without using an expensive offset-preventing agent and can give clear images, irrespective of the type of the copying machine. It is appreciated that there is a marked difference from the Comparative Examples in regard to the right fixing temperature width ΔT.

| | Binder resin | | | | | |
|---|---|---|---|---|---|---|
| | Carboxyl-containing addition polymer (a) | Metal forming the salt | N | $\frac{N \cdot \overline{Mw}}{2}$ | External lubricant | Carrier particles |
| Example 1 | EA (48%)-BMA (44%)-AA (8%) terpolymer (Mw = 19,000) | Ca | $2.1 \times 10^{-4}$ | 2.0 | Low-molecular weight polyethylene | iron oxide powder (150–200 mesh) |
| Comparative Example 1 | EA (48%)-BMA (44%)-AA (8%) terpolymer (Mw = 19,000) | Ca | $1.1 \times 10^{-3}$ | 10.45 | Low-molecular weight polyethylene | |
| Comparative Example 2 | EA (48%)-BMA (44%)-AA (8%) terpolymer (Mw = 19,000) | Ca | $6.1 \times 10^{-6}$ | $5.7 \times 10^{-2}$ | Low-molecular weight polyethylene | |
| Example 2 | EA (48%)-BMA (44%)-AA (8%) terpolymer (Mw = 19,000) | Ca | $2.1 \times 10^{-4}$ | 2.0 | Isotactic polypropylene | |
| Example 3 | EA (48%)-BMA (44%)-AA (8%) terpolymer (Mw = 19,000) | Ca | $2.1 \times 10^{-4}$ | 2.0 | Microcrystalline wax | |
| Example 4 | EA (48%)-BMA (44%)-AA (8%) terpolymer (Mw = 19,000) | Ca | $2.1 \times 10^{-4}$ | 2.0 | Zinc stearate | |
| Example 5 | St (70%)-BA (18%)-AA (12%) terpolymer (Mw = 11,800) | Ca | $1.6 \times 10^{-3}$ | 9.4 | Low-molecular weight polyethylene | |
| Example 6 | St (73.7%)-BMA (23.9%)-AA (2.4%) terpolymer (Mw = 30,000) | Fe | $1 \times 10^{-4}$ | 1.5 | Microcrystalline wax | |
| Example 7 | St (73.7%)-BMA (23.9%)-AA (2.4%) terpolymer (Mw = 30,000) | Mg | $1 \times 10^{-4}$ | 1.5 | Microcrystalline wax | iron oxide powder (125–200 mesh) |
| Example 8 | St (73.7%)-BMA (23.9%)-AA (2.4%) terpolymer (Mw = 30,000) | Zn | $1 \times 10^{-4}$ | 1.5 | Microcrystalline wax | |
| Example 9 | St (73.7%)-BMA (23.9%)-AA (2.4%) terpolymer (mw = 30,000) | Al | $1 \times 10^{-4}$ | 1.5 | Microcrystalline wax | |
| Example 10 | St (73.7%)-BMA (23.9%)-AA (2.4%)terpolymer (Mw = 30,000) | Al | $5 \times 10^{5}$ | 0.75 | Microcrystalline wax | |
| Example 11 | St (73.7%)-BMA (23.9%)-AA (2.4%) terpolymer (Mw = 30,000) | Al | $2 \times 10^{-5}$ | 0.3 | Microcrystalline wax | |

NOTE:
*measured by using a reflecto-densitometer (made by McBeth Company)
EA: ethyl acrylate
BMA: butyl methacrylate
AA: acrylic acid
St: styrene
BA: butyl acrylate

| | Image density (*) | Soiling of white background (*) | TL (minimum temperature of fixation) (°C.) | TH (offset phenomenon occurring temperature) (°C.) | ΔT (=TH—TL) (the right fixation temperature width) (°C.) | Copying machine used |
|---|---|---|---|---|---|---|
| Example 1 | 1.10 | 0.01 | 160 | 190 | 30 | EP-1 (made by Minolta Camera Co., Ltd.) |
| Comparative Example 1 | 1.05 | 0.05 | 200 | — | — | |
| Comparative Example 2 | 1.10 | 0.01 | 150 | 150 | 0 | |
| Example 2 | 1.10 | 0.01 | 160 | 190 | 30 | |
| Example 3 | 1.10 | 0.01 | 160 | 190 | 30 | |
| Example 4 | 1.10 | 0.01 | 160 | 190 | 30 | |
| Example 5 | 1.10 | 0.01 | 160 | 190 | 30 | |
| Example 6 | 1.20 | 0.01 | 160 | 200 | 40 | BD-901 (made by Tokyo Shibaura Denki Co., Ltd.) |
| Example 7 | 1.20 | 0.01 | 160 | 200 | 40 | |
| Example 8 | 1.20 | 0.01 | 160 | 200 | 40 | |
| Example 9 | 1.20 | 0.01 | 160 | 200 | 40 | |
| Example 10 | 1.20 | 0.01 | 160 | 195 | 35 | |
| Example 11 | 1.20 | 0.01 | 160 | 190 | 30 | |

NOTE:
(*) measured by using a reflecto-densitometer (made by McBeth Company)

What we claim is:

1. In a method for fixing, by a hot press roll, powdery toner images obtained by developing latent electrostatic images, the improvement wherein the offset phenomenon is prevented by using, as said powdery toner, a uniformly blended mixture of a coloring agent, a binder resin and a fixing aid, said binder resin comprising a polyvalent metal salt (b) of a carboxyl-containing addition polymer (a) which satisfies the following expressions $$10^{-2} < (N \cdot \overline{M}w)/2 < 10$$

$$10^{-5} < N < 2 \times 10^{-3}$$

wherein N is the number of moles of metal carboxylate ions contained per gram of the polyvalent metal salt (b), and $\overline{M}w$ represents the weight average molecular weight of the addition polymer (b), and said fixing aid comprising at least one compound selected from the group consisting of waxes, fatty acid amides and metal soaps.

2. The method of claim 1 wherein the content of said polyvalent metal salt (b) is at least 30% by weight based on the weight of the binder resin.

3. The method of claim 1 wherein the content of the fixing aid is 0.01 to 10% by weight of the toner.

4. The method of claim 1 wherein the fixing aid is a wax selected from the group consisting of paraffin wax, microcrystalline wax, polyolefin wax, and ester-type waxes.

5. The method of claim 1 wherein the fixing aid is a fatty acid amide selected from the group consisting of lauric amide, myristic amide, palmitic amide, stearic amide, arachidic amide, behenic amide, olefic amide, eicosanoic amide, erucic amide, elaidic amide, linolic amide, linoleic amide, ricinoleic amide, and methylenebisamide.

6. The method of claim 1 wherein the fixing aid is a metal soap selected from the group consisting of calcium stearate, calcium laurate, calcium ricinolate, zinc stearate, zinc laurate, lead stearate, and tin stearate.

7. The method of claim 1 wherein wherein the polyvalent metal salt (b) of the carboxyl-containing addition polymer (a) is the only binder resin.

8. The method of claim 1 wherein the polyvalent metal of the polyvalent metal salt is selected from the group consisting of calcium, iron, magnesium, zinc and aluminum.

9. The method of claim 1 wherein the coloring agent is carbon black.

10. The method of claim 1 wherein the coloring agent comprises a dye selected from the group consisting of nigrosine dye, aniline dye, chrome yellow, ultramarine blue, methylene blue chloride, and rose bengal.

* * * * *